US005383309A

United States Patent [19]

Sampietro

[11] Patent Number: 5,383,309

[45] Date of Patent: Jan. 24, 1995

[54] ABRASIVE TOOL

[75] Inventor: Bruno Sampietro, Milan, Italy

[73] Assignee: Norton Company, Worcester, Mass.

[21] Appl. No.: 150,325

[22] Filed: Nov. 9, 1993

Related U.S. Application Data

[63] Continuation of Ser. No. 999,257, Dec. 31, 1992, abandoned.

[30] Foreign Application Priority Data

Jul. 9, 1992 [IT] Italy ..... MI92U000684

[51] Int. Cl.[6] ..... B24D 11/02

[52] U.S. Cl. ..... 451/533; 451/539

[58] Field of Search ..... 51/401, 406, 407, 394

[56] References Cited

U.S. PATENT DOCUMENTS

| | | | |
|---|---|---|---|
| 4,576,612 | 3/1986 | Shukla | 51/407 |
| 4,606,154 | 8/1986 | Herrmann | 51/401 |
| 4,733,502 | 3/1988 | Braun | 51/406 |
| 5,007,128 | 4/1991 | Englund | 51/394 |
| 5,170,595 | 12/1992 | Wiand | 51/406 |
| 5,239,783 | 8/1993 | Matechuk | 51/170 T |
| 5,309,681 | 5/1994 | Cheney et al. | 51/170 R |

FOREIGN PATENT DOCUMENTS 3903204 2/1990 Germany .

*Primary Examiner*—Jack W. Lavinder
*Attorney, Agent, or Firm*—David Bennett

[57] ABSTRACT

An abrasive tool, such as a disc, which is adapted for ready attachment and release from the back-up pad of a sanding or polishing machine by means of a hook and loop means is improved by the interposition of a resilient foam layer between the abrasive-containing layer and the layer comprising the hook and loop attachment means.

6 Claims, 1 Drawing Sheet

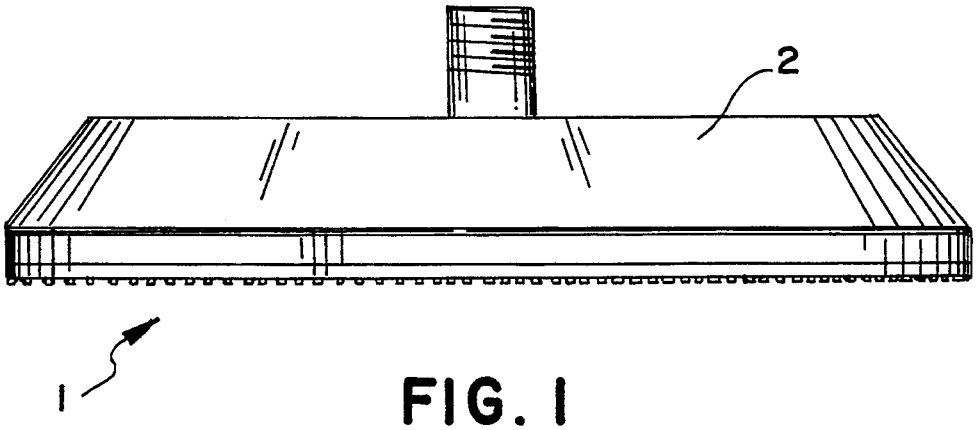
FIG. 1
FIG. 2
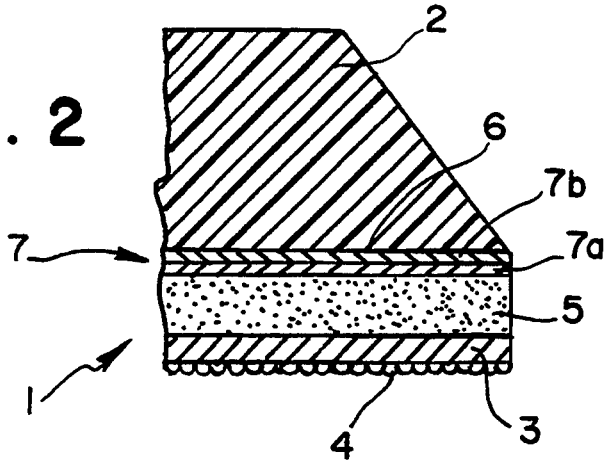

ABRASIVE TOOL

This is a continuation of copending application Ser. No. 07/999,257 filed on Dec. 31, 1992, now abandoned.

BACKGROUND OF THE INVENTION

This invention refers to an abrasive tool, such as a disc, strip and the like, for a sanding and polishing machine of the type comprising an abrasive-containing layer and a fabric backing layer adapted to be fastened to a plate on the machine.

It is known that sanding and polishing operations are carried out by machines that use readily detachable and replaceable abrasive discs, abrasive strips, or similar tools, releasably fastened to suitable plates, which move in a generally orbital or reciprocating fashion. In this specification, the term "tool" is used to describe all forms of releasably attached discs, belts or strips and the like.

Such sanding and polishing operations conventionally use fine grits with grit sizes of 80 and smaller and it is the context of such products that this invention finds its greatest utility.

Current sanding and polishing techniques substantially meet the requirements of the industrial sector, for instance, in auto-body assembly lines, as well as the crafts sector such as in auto-body shops. There are, however, widespread complaints about the disadvantage of uneven wear on the abrasive coating.

This results in an inefficient use of the tool, which is discarded before it is completely used up, and poor sanding and polishing performance, probably owing to the fact that the abrasive tends to get stuck in the worn-out area.

In some cases attempts have been made to interpose a polymeric layer between an abrasive sheet and an attachment means comprising a pressure sensitive adhesive (PSA) layer. Such devices have not proved totally satisfactory because of the inherent problems associated with PSA materials such as stringiness, deposition on the plate to which the tool is adhered in use, performance variation with temperature and humidity and so on. In addition, if the PSA is applied directly to the polymeric layer, or to a paper layer attached to the polymeric layer, any plasiticizer present therein can migrate through the paper and deteriorate the PSA very seriously. The present invention permits a much more versatile approach to the use of detachable abrasive tools that at the same time gives distinct additional performance improvements.

The purpose of this invention is to provide an abrasive tool of the type specified which overcomes the disadvantages mentioned above.

DESCRIPTION OF THE INVENTION

The abrasive tool of the invention comprises an abrasive containing layer and a fabric substrate adapted for hook and loop attachment to a support plate, and a resilient foam layer located between the abrasive containing layer and the fabric substrate.

The fabric substrate may be attached directly to the resilient foam layer or it may be provided with an intermediate scrim or a plastic or paper layer firmly adhered to both the intermediate layer and to the foam layer.

The resilient foam layer may be of any suitable material such as a polyurethane, a natural or artificial rubber such as a polybutadiene, polyisoprene, EPDM polymer, PVC, polychloroprene, or styrene/butadiene copolymer. Generally polyurethane foams have the right combination of resilience and strength to withstand the considerable shear forces that are encountered in use.

The abrasive-containing layer comprises the abrasive and a binder holding the abrasive to a substrate backing layer. The abrasive itself can be any one of those commonly used as abrasives such as fused alumina, alumina/zirconia, silicon carbide or sol-gel process formed, (seeded or unseeded), ceramic alumina grains. The binder can be any of the commonly used binders such as phenolic resins, polyurethanes, epoxy resins and radiation curable resins. The backing layer may be a fabric but more frequently it is a paper or a plastic sheet. The paper is conventionally a heavy duty paper of the type commonly used for abrasive disc products. The backing layer, where this is a fabric, may have been treated with one or more fill coats prior to being coated, and the abrasive-containing layer can have placed over it a size coat and, optionally, a supersize coat.

DESCRIPTION OF THE DRAWINGS

Further features and advantages of the abrasive tool according to this invention will become clear from the following description of a preferred model, given in an indicative, but not limiting manner, with reference to the attached figures, where:

FIG. 1 shows a top view of the plate of a sanding and polishing machine, fitted with an abrasive tool in accordance with this invention.

FIG. 2 shows a section view of a detail of the tool in FIG. 1.

The Drawings show an abrasive tool comprising, in this example, a 150 mm diameter disc, (1) attached to a plate (2) of equal diameter on a sanding and polishing machine.

The disc (1) comprises a flexible support (3), generally, a sheet of a fabric, paper or plastic material. On one side of support (3) is a coating of an abrasive material (4), such as aluminum oxide. This flexible support (3) together with the abrasive-containing layer is referred elsewhere as the "abrasive-containing layer".

Adhered to the other side of the flexible support (3) is a layer (5) of a resilient material, such as plastic foam. Polyurethane is a suitable plastic material. The preferred thickness of this layer (5) is between 1 to 5 mm, preferably 3 mm.

The density of the layer (5) is preferably between 20 and 30 $kg/m^3$, preferably 25 $kg/m^3$.

Layer (5) can be attached to the flexible support (3) with an appropriate adhesive or by heat.

Layer (5) is covered with a fabric (6) bearing on the opposite face to that adhered to the resilient foam layer, one cooperating component of a hook and loop attachment system. In the Drawings the component attached to the fabric (6) is the loop component *(7a)*. The most frequently encountered variant of such systems is sold under the trade name of "Velcro". The purpose of the system is to provide a means for releasably adhering the tool to the plate (2) which bears the other component of the system, (as shown here, the the "hook" component), shown as fabric component *(7b)*.

On the disc (1), layer (5) is found between support (3), which is intended to engage the work surface with the coating of abrasive material, and the coating of adhesive material, which is designed to engage the plate.

Because of its resilience, the layer (5) absorbs the differences in shape between the work surface, which may be irregular, and the plate which is substantially flat, enabling the use of the entire abrasive surface.

The tool has shown an increased life, an even wear, and optimal self-cleaning capability.

Since the presence of the layer of resilient foam material gives the abrasive material increased pliancy, it is possible to work uneven surfaces also with harder plates. This also allows a longer life for the plate.

An improved adhesion of the tool to the plate has been noted, being effective over a long period even under intensive working conditions.

Obviously, an expert in the field may make numerous modifications and variations to the tool described here in order to satisfy contingent and specific requirements; all modifications and variations, however, shall be restricted by the protection of this invention, which is defined by the following claims.

What we claim is:

1. An abrasive tool comprising an abrasive-containing layer comprising a flexible support having a layer of abrasive particles bonded thereto and a fabric substrate adapted for hook and loop attachment to a support plate, and a resilient foamed polyurethane layer having a density between about 20 and about 30 kg/m$^3$ located between and adhered to the abrasive-containing layer and the fabric substrate.

2. An abrasive tool according to claim 1, characterized by the fact that the layer of resilient foam material is adhered directly to both the abrasive-containing layer and the fabric substrate.

3. An abrasive tool according to claim 1 in which the resilient foam layer has a thickness of between about 1 and about 5 mm.

4. An abrasive tool according to claim 1 in which an intermediate layer selected from the group consisting of scrim, plastic or paper layers is interposed between and firmly adhered to both the fabric substrate and the resilient foam layer.

5. An abrasive tool according to claim 1 in the form of a disc.

6. An abrasive disc comprising a fabric substrate layer adapted to be affixed releasably by hook and loop means to a support plate on a rotary sander device, said substrate layer being adhered to a first surface of a foamed polyurethane layer with a density of from about 20 to about 30 kg/m$^3$ and a thickness of from about 1 to about 5 mm, the opposed second surface of the foam layer being adhered to an abrasive-containing layer.

* * * * *